United States Patent [19]

Fryer

[11] Patent Number: 4,914,935

[45] Date of Patent: Apr. 10, 1990

[54] METHOD AND APPARATUS FOR LAYING COILED ROD STOCK

[75] Inventor: George R. Fryer, Warren, Conn.

[73] Assignee: Fryer Corporation, Oxford, Conn.

[21] Appl. No.: 291,284

[22] Filed: Dec. 28, 1988

[51] Int. Cl.[4] ..... B21F 3/00; B21B 43/00

[52] U.S. Cl. ..... 72/201; 140/2; 242/82; 242/83; 266/106

[58] Field of Search ..... 72/128, 135, 137, 201; 140/2; 148/153, 156; 242/82, 83; 266/106

[56] References Cited

U.S. PATENT DOCUMENTS

| | | | |
|---|---|---|---|
| 1,984,744 | 12/1934 | Hood | 242/79 |
| 3,300,158 | 1/1967 | Strong | 242/83 |
| 3,360,842 | 1/1968 | Hill et al. | 140/2 |
| 3,405,885 | 10/1968 | Schroder et al. | 242/83 |
| 3,469,798 | 9/1969 | Schroder et al. | 242/83 |
| 3,516,139 | 6/1970 | Pratt | 72/426 X |
| 3,557,438 | 1/1971 | Sieger | 140/2 X |
| 3,603,355 | 9/1971 | Geipel et al. | 140/2 |
| 3,615,083 | 10/1971 | Feinman et al. | 266/106 X |
| 3,627,184 | 12/1971 | Berz et al. | 226/74 |
| 3,711,918 | 1/1973 | Shore | 226/74 |
| 3,756,289 | 9/1973 | Rotert et al. | 140/2 |
| 3,770,025 | 11/1973 | Hirschfelder et al. | 140/2 |
| 3,832,788 | 9/1974 | Kato et al. | 266/106 X |
| 3,865,153 | 2/1975 | Vitelli | 140/2 |
| 4,011,780 | 3/1977 | David | 83/167 |
| 4,044,938 | 8/1977 | Heiss | 226/168 |
| 4,310,031 | 1/1982 | Appel et al. | 140/2 |
| 4,357,965 | 11/1982 | Kosuge et al. | 140/2 |
| 4,362,040 | 7/1982 | Yamaguchi et al. | 72/201 |
| 4,437,620 | 3/1984 | Ozawa | 242/83 |

FOREIGN PATENT DOCUMENTS

| | | | |
|---|---|---|---|
| 0132588 | 2/1985 | European Pat. Off. | 72/201 |
| 59-39486 | 9/1984 | Japan | 72/201 |
| 63-194814 | 8/1988 | Japan | 72/201 |

*Primary Examiner*—E. Michael Combs

*Attorney, Agent, or Firm*—Robert H. Montgomery

[57] ABSTRACT

A method and an apparatus for use in dropping metal rod stock which is continuously formed in succeeding loops into a coil, where the loops are in spaced apart overlapping relationship moving on a conveyor where the apparatus comprises pinching means disposed on either side of a horizontal conveyor adjacent the drop-off end thereof and spaced a distance apart which is less than the width of the loops, the pinching means including movable means engaging the loops whereby the loops are compressed in one direction and elongated in the other as the loops pass through the pinching means and held in a generally horizontal plane after exiting the conveyor, and dropped vertically from engagement with the movable means to a collection device.

23 Claims, 7 Drawing Sheets

METHOD AND APPARATUS FOR LAYING COILED ROD STOCK

FIELD OF THE INVENTION

This invention relates to a rod mill where metal is rolled down to rod stock.

BACKGROUND OF THE INVENTION

In a rod mill, at least in one form thereof, as the rolled down rod leaves the final rolls, it is passed through a laying head. This causes the rod to form in helices or loops, and as the helices leave the laying head, they are presented to a conveyor, where the helices or loops are laid in overlapping relationship on the conveyor and are transported to a collection point which, in some cases, is what is known as a reform tub. There the helices fall upon one another as they leave the conveyor. The purpose of the conveyor is to collect the helices as they leave the laying head and also to permit time for the rod stock to cool. In some cases, air is blown through the conveyor to uniformly cool the rod stock.

As previously mentioned, the helices are dropped into what may be called a reform tub or, in some cases, they fall on to a central mandrel. After the reform tub or mandrel is full, the resulting pile of helices will be removed from the reform tub or mandrel and then compacted and banded or tied parallel to the axis of the coil for transportation. Since all of the helices are of the same size, they do not package well. Subsequent handling and shipping of these coils causes the bands or ties to become loose, resulting in damage to the coils.

This problem has long been recognized in rod mills, but no successful solution has yet been found.

Accordingly, the present invention provides new and improved method and apparatus for acting upon the helices or loops of formed rod stock as such helices or loops approach and arrive at the end of the conveyor, such that the centers of the loops are offset in succeeding loops as the loops are dropped from the conveyor into the reform tub and each helix or loop is slightly angularly displaced from the preceding helix or loop so that there is little tendency or possibility of loops falling within one another in the reform tub or on the madrel or during compacting and binding or tying to produce payoff tangles in subsequent payoff process.

SUMMARY OF THE INVENTION

The invention is practiced, in one form thereof, by compressing the helices or loops as they move down the conveyor and just before the drop-off point to the reform tub or mandrel. This casts the individual loops into a slightly elliptical form and each helix or loop will then drop off at the same point. However, the loops will be angularly displaced from the preceding helix or loop and the resulting coil in the tub or about the mandrel will have succeeding loops off-center with respect to a preceding or succeeding helix or loop.

This is accomplished by providing a pinching or squeezing mechanism at the end of the conveyor through which the loops must pass. The pinching apparatus comprises two devices which are mirror images and are adjustable as to the spacing therebetween, dependent upon the dimension or diameter of the helices of the rod stock moving down the conveyor. The pinching or squeezing mechanisms preferably comprise opposed endless belts which are movable on opposing sides of the conveyor and which initially define a tapering down passage portion to gradually increase the compression on the helices, and then a portion with parallel moving walls, which engage the helices and hold them to a drop-off point which is the same for each helix.

The invention may also be used in what is referred to as a "slow cool" process to increase the pitch between succeeding loops as the loops are transferred from a relatively slow moving conveyor to a faster moving conveyor.

An object of this invention is to provide a new and improved apparatus and method for delivering helices or loops of rod stock on a conveyor to a drop-off point on to a mandrel or into a reform tub.

The features of the invention which are believed to be novel are particularly pointed out and distinctly claimed in the concluding portion of the specification. The invention, however, together with further objects and advantages thereof, may best be appreciated by reference to the following detailed description taken in conjunction with the drawings.

DETAILED DESCRIPTION OF PREFERRED EMBODIMENT OF THE INVENTION

The method of practicing the invention and apparatus therefor will now be described.

To best explain the advantages of the invention, the final confirmation of rod stock achieved by practice of the invention will first be explained.

Figure 1:
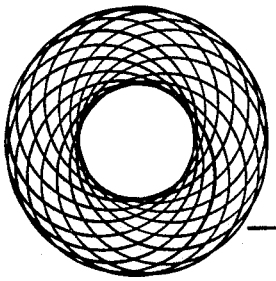
FIG. 1 is a schematic plan view of helices or loops of rod stock on collection after drop-off from a conveyor.

FIG. 1 is a schematic plan view of a series of helices or loops after they have fallen from a conveyor into a reform tub after leaving the conveyor. It will be noted that the loops are on centers which are displaced from each other. Therefore, the individual loops or helices will not fall within each other, but will lay on top of each other.

Figure 2:
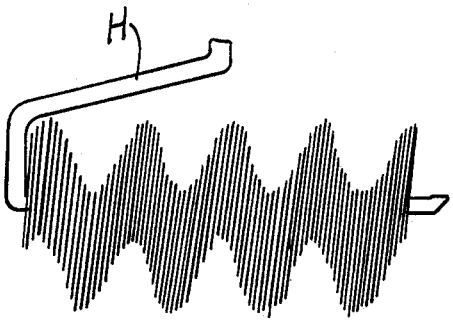
FIG. 2 is a schematic side elevation of a coil of rod stock shown on a pickup hook but exaggerated in peaks and valleys for simplicity of disclosure.
Figure 3:
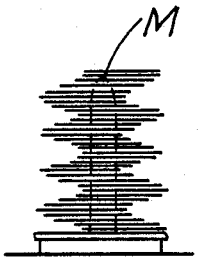
FIGS. 3 and 4 are schematic side elevations of coils of rod stock formed in accordance with the invention but exaggerated for purposes of disclosure.
Figure 4:
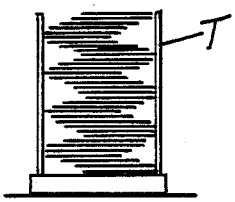

FIG. 2 illustrates the loops or helices as picked up on a hook H for transportation. FIG. 3 shows the rod stock as it is collected on a mandrel M, and FIG. 4 shows the rod stock as it may be collected in a reform tub T after falling from a conveyor. With these shapes of layered coils, the adjacent helices or loops will not tend to nest within each other and will not bind. The offset centers or approximate offset centers of each loop will prevent one loop from falling within another.

Figure 5:
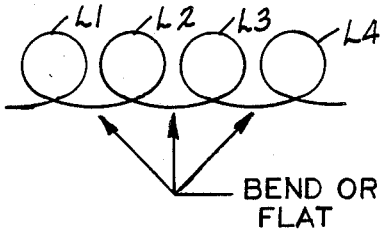
FIG. 5 is a representation of loops of rod stock with greatly exaggerated pitch which is helpful in explaining the invention.

FIG. 5 exemplifies loops or helices of the rod stock as it moves on the conveyor, but with the loop separation greatly exaggerated. The loops L1, L2, L3, and L4 actually are in closely overlapping relation, but for clarity of explanation, are shown as separated. The compression or pinching process hereinafter described will produce bending or flattening at the connecting portions between adjacent loops. This causes the loops to form on effective centers along an accurate or curved line A. As the loops fall from the conveyor, they will be in a pattern as shown in plan view in FIG. 1, and as collected will overlay each other in a pattern as shown in FIGS. 3 and 4.

Figure 7:
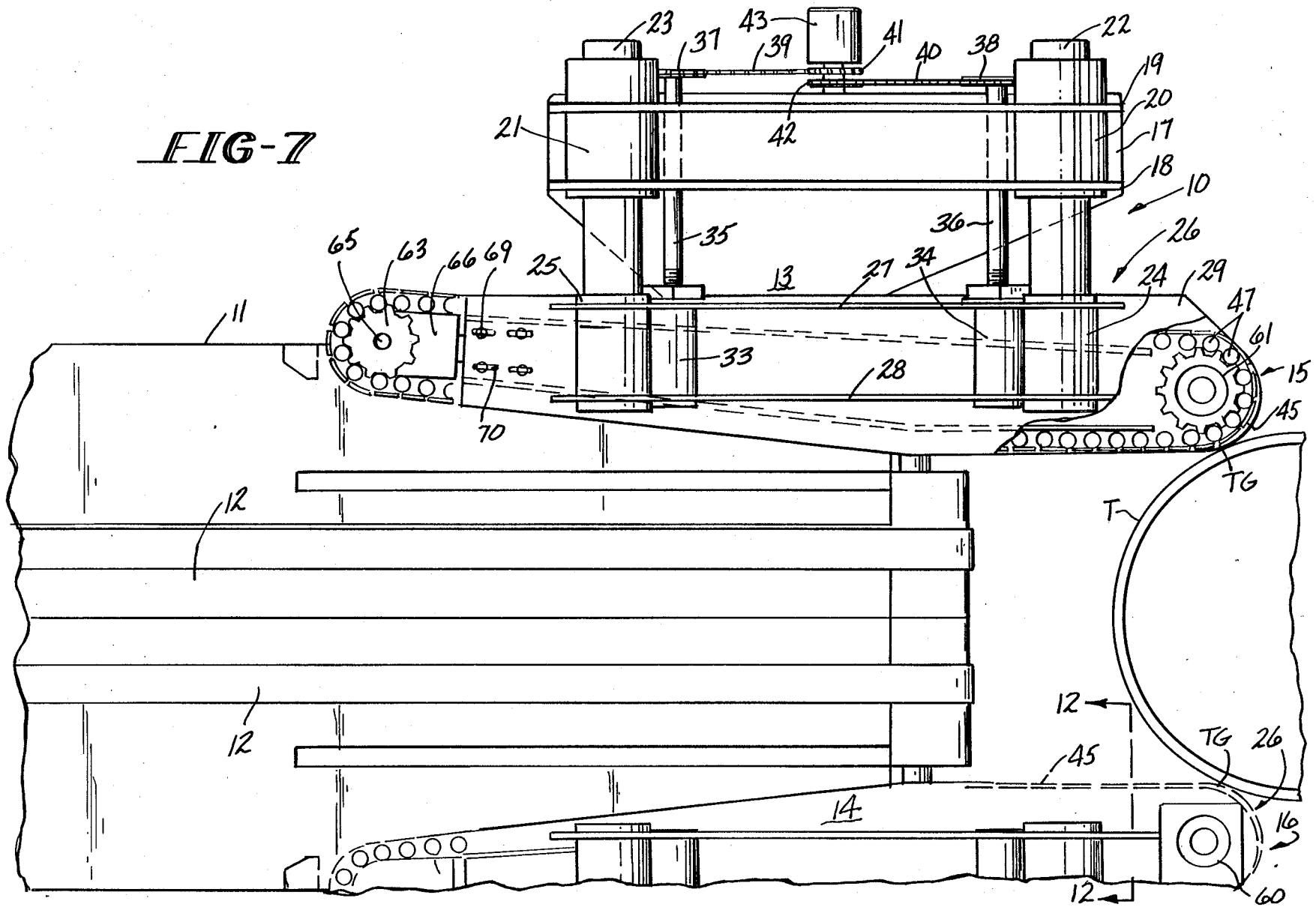
FIG. 7 is a plan view of a mechanism for practicing the invention with portions thereof broken away.
Figure 8:
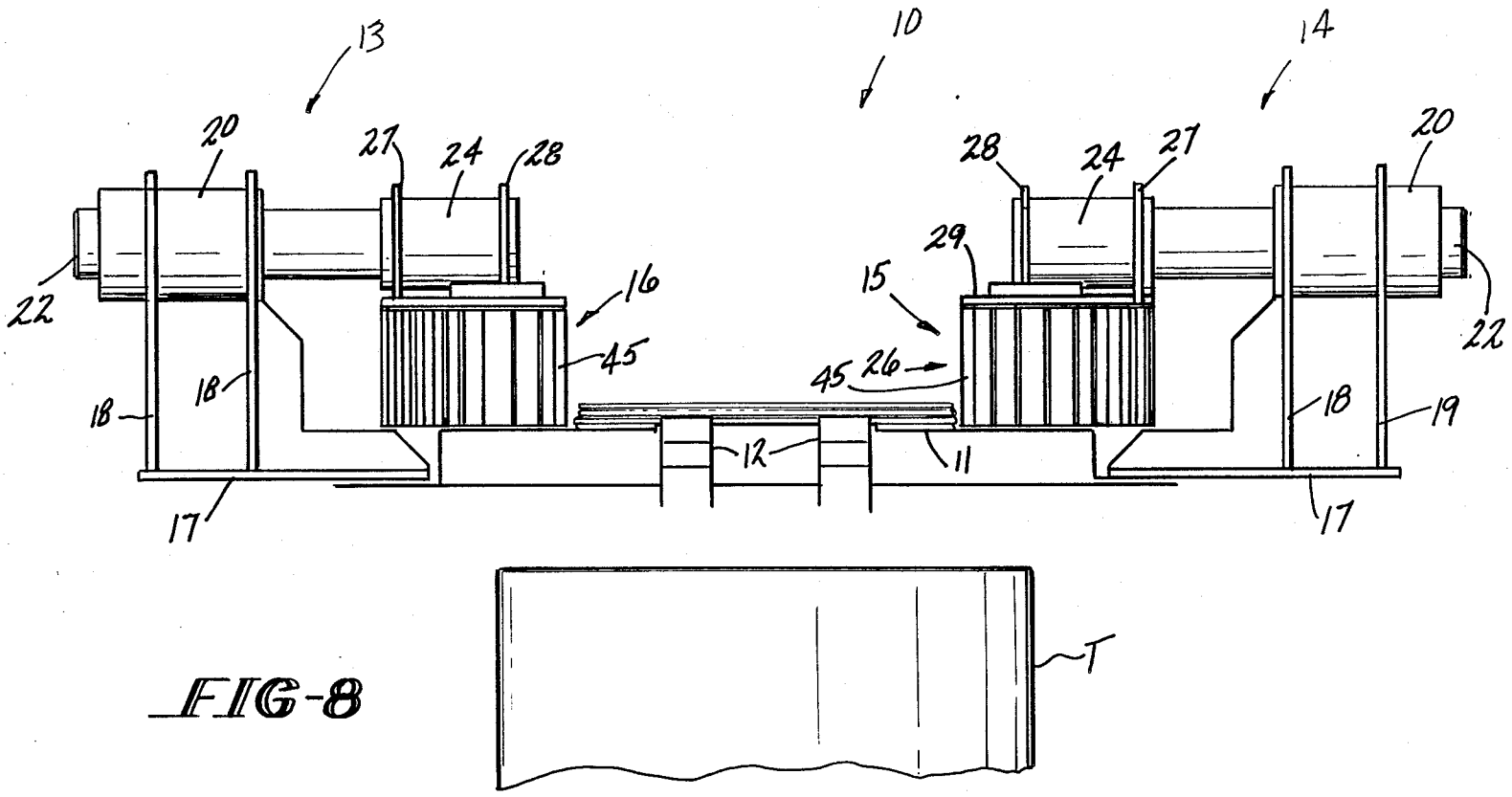
FIG. 8 is an elevation of the apparatus of FIG. 7 seen from the right side thereof.
Figures 9, 12:
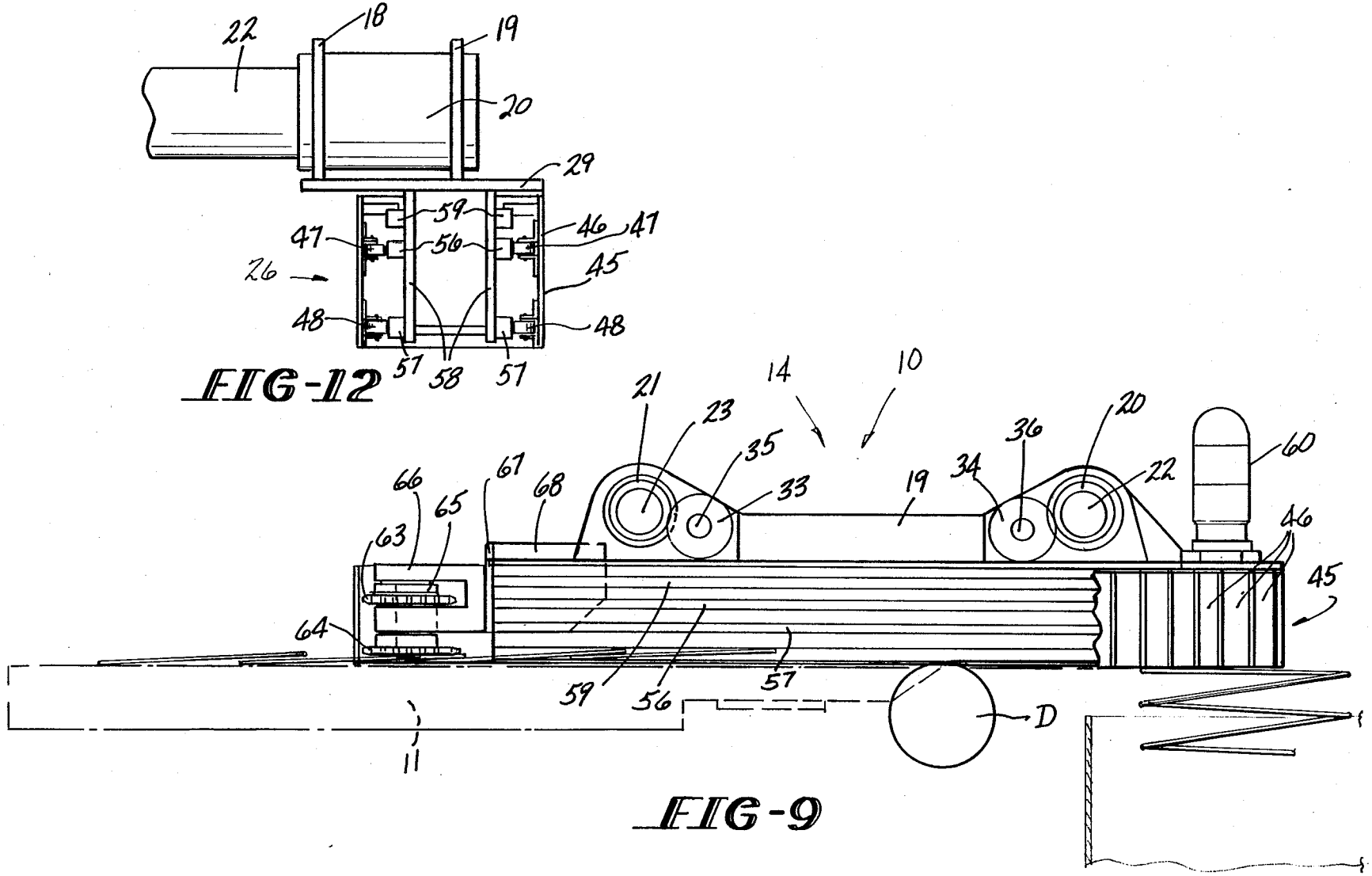
FIG. 9 is a side elevation of the apparatus of FIG. 7 seen from the lower side of FIG. 1.
FIG. 12 is a view seen in the plane of lines 12—12 of FIG. 7.

Reference is now made to FIGS. 7, 8, and 9. As shown in the plan view of FIG. 8 and the elevation of FIG. 9, apparatus 10 embodying the invention is positioned on either side of a conveyor base 11, upon which the rod stock is moving on conveyor chains 12 towards a tub or a pit T.

Apparatus for practicing the invention preferably comprises two pinching mechanisms 13 and 14, each of which comprise movable metal belt conveyors and supports therefor 15 and 16, which are mirror images of each other. Each of the devices 15 and 16 comprises a base 17 (FIG. 8) having upright members 18 and 19 extending vertically therefrom. Upright members 18 and 19 support bearings 20 and 21 which slidably support shafts 22 and 23, repectively, therein. Shafts 22 and 23 extend from support members 24 and 25, respectively, which, in turn, support a conveyor belt mechanism 26, as will hereinafter be described. The shaft support members 24 and 25 are mounted to upright members 27 and 28, which extend vertically upwardly from a top plate 29. The belt mechanisms 26 reside just above conveyor base 11.

The conveyor belt mechanisms 26 may be moved towards or away from the center line of the conveyor base 11 by means of the support shafts 22 and 23 being slidable in bearings 20 and 21, respectively. To accomplish such movement, each of members 26 carries a pair of fixed nuts 33 and 34, which receive screw shafts 35 and 36, respectively. Received on the ends of screw shafts 35 and 36 are sprockets 37 and 38, respectively, which are driven by sprocket chains 39 and 40, respectively, which are driven by sprockets 41 and 42 on the shaft of a motor 43. When motors 43 are energized, dependent upon the direction of rotation, it will move the belt mechanisms 15 and 16 toward or away from the center line of conveyor base 11.

Figure 11:
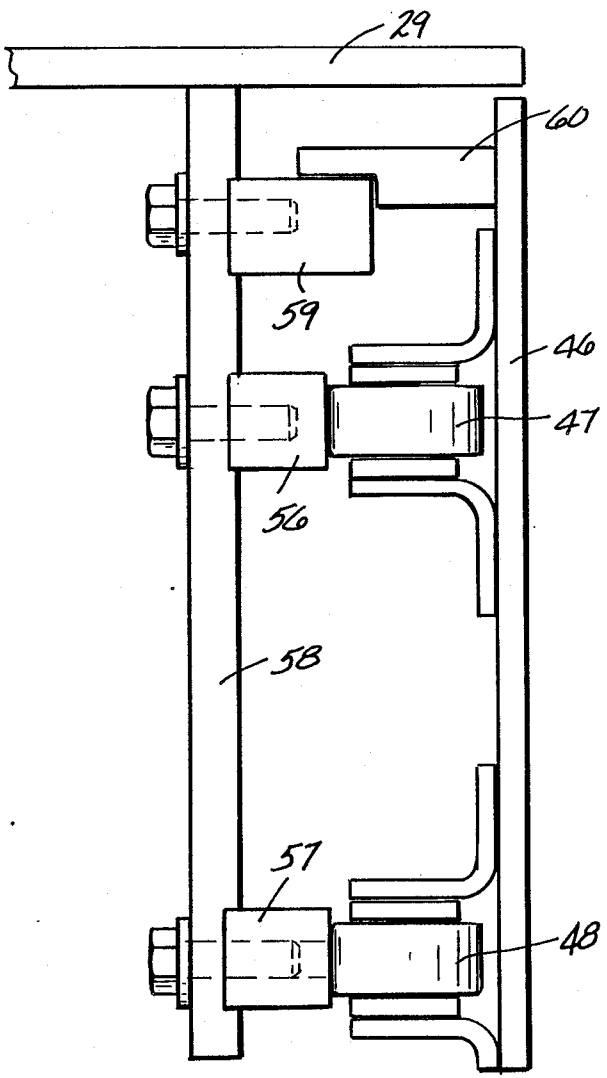
FIG. 11 is a side view of the belt of FIG. 10.
Figure 10:
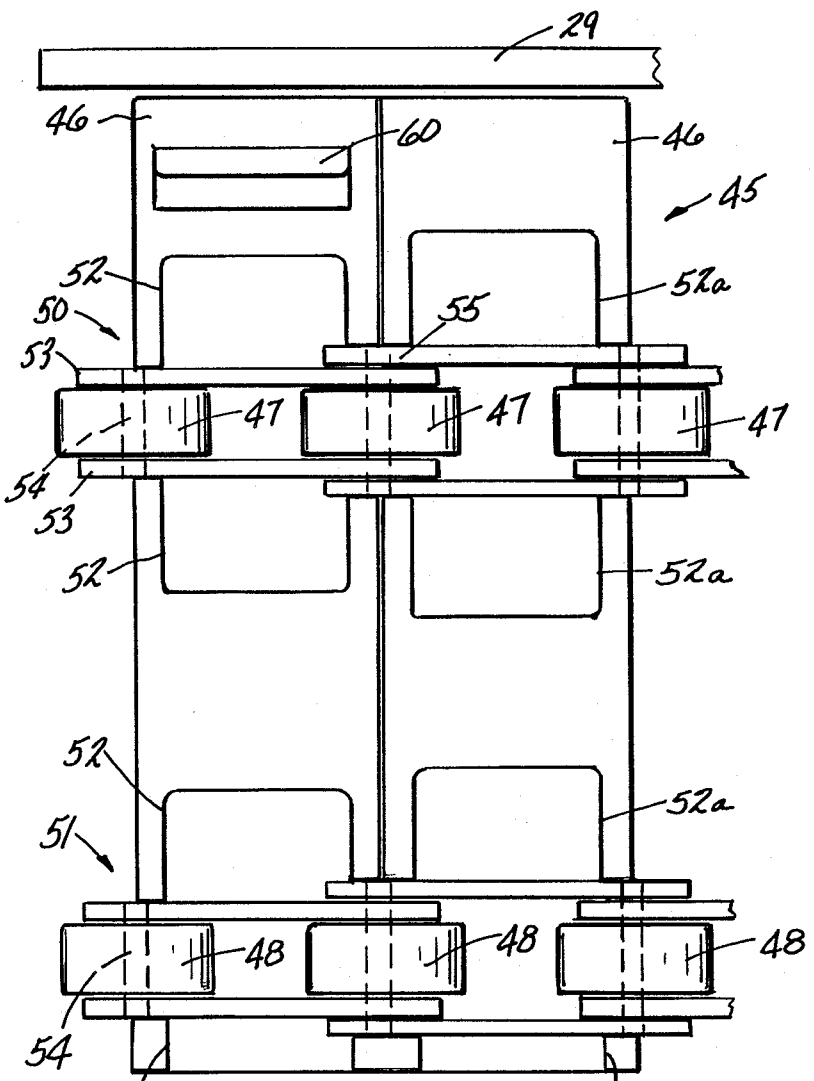
FIG. 10 is a view seen from the interior side of segments of a belt utilized in the invention.

Each of the mechanisms 15 and 16 include a belt 45, which belt is made up of a plurality of segments 46 (FIG. 10). The segments 46 are joined in an endless belt 45 as hereinafter described. As shown in FIGS. 11 and 12, the segments 46 carry upper and lower rows of rollers 47 and 48. The rollers are positioned on center lines at or between adjoining belt segments. This permits articulation of the segments 46. Alternate segments have slightly different support means for the rollers. The left hand segment in FIG. 10 has upper and lower bearing support brackets 50 and 51. Each of brackets 50 and 51 comprise upper and lower L-shaped members having a vertical backing portion 52 and a horizontal roller shaft support portion 53 of greater width than backing portion 53. A shaft 54 extends through support portions 53 to rotatably mount a roller 47 or 48 therein.

The adjacent right hand half segment uses the same support brackets designated by the same reference numeral with the suffix "a" affixed thereto. The only difference is that the support portions 52*a* are spaced wider apart to receive the ends of support portions 53. At the overlap, a longer shaft 55 is used. With this construction, each segment 46 is pivotal with respect to adjacent segments, and the rollers may be utilized to drive belts 45.

The rollers 47 and 48 bear against tracks 56 and 57, respectively, which are mounted on upright members 58 (only one shown in FIG. 11) depending from top plate 29. As may be seen in FIG. 11, horizontally extending support members 59 are affixed to member 58 along the length thereof, which are overlapped by a support member 60 extending from alternate segments 46.

The rollers 47 and 48 provide a dual function in that they define a sprocket chain carrying the segments 46, and also bear on the backup members 55 and 56, as belt 45 moves to compress the helices.

Reference is briefly made to FIG. 12, which is a section through the belt of assembly 16, where it will be seen that each of the belt assemblies 26 comprises the support members 58 depending from top plate 29.

As shown in FIGS. 7 and 9, each of the pinching assemblies 13 and 14 includes a drive motor 60 located at the loop drop-off end thereof. The drive motors 60 have sprocket gears 61 which engage between the top rollers 47 and the lower rollers 48 to drive the belts 45. The motors 60 are hydraulic and are connected in series so that they will always drive at the same speed.

With reference to FIG. 9, at the other end of each of the assemblies 16 is a pair of idler sprockets 63 and 64 rotatably mounted on a shaft 65 carried in a bracket or yoke 66. Bracket 66 has an extension 67 which is affixed to a plate 68. Plate 68 is adjustably fixed to top plate 29 by a plurality of bolts 69 (FIG. 7) extending through elongated slots 70 in plate 68 into sockets in top plate 29. This permits longitudinal movement of bracket 66 to properly tension belts 45.

For operation, the belts 45 will be properly tensioned by the longitudinal positioning of bracket 66. The assemblies 15 and 16 as shown in FIGS. 8 and 9 are then positioned with respect to conveyor base 11 to define a given dimension therebetween for the casting of the loops as they enter the mechanism 10 and drop off the end of conveyor onto a mandrel or a reform tub.

Figure 6:
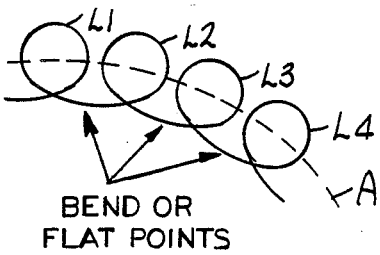
FIG. 6 is a representation of loops of rod stock with greatly exaggerated pitch after having been acted upon in accordance with the invention.

As the helices are pinched or compressed, the long side of the helices are bent toward a flattened position as shown in FIG. 5, where the helices are shown in exaggerated expanded form. What is referred to as the long side of the helices is denoted as Bend or Flat. The long side is flattened and thus tends to cast the succeeding helices in a circular pattern, as shown in FIG. 6. As a result, when the loops fall upon one another about a mandrel or in a reform tub, the loops will also be slightly elliptical. The combination of the slightly elliptical shape and the circular casting of the helices, as shown in FIG. 6, causes the helices to take the form seen in plan view in FIG. 1 in the reform tub or about a mandrel. The size of the resulting coil of the layered helices or loops can be varied by the dimension of the diameter of the mandrel M or the diameter of the reform tub T.

The result is a coil of rod which may be compacted and banded with a controlled coil shape without the individual loops falling within one another and without individual helices kinking or knotting or the coil humping intermediate its ends and provide a coil which may be uniformly compacted and banded.

In FIG. 9, the conveyor is shown in broken line, and a sprocket therefor is identified by the reference D.

It will be noted that as the loops leave the conveyor, they will still be supported by the parallel portions of the belts 45 of members 15 and 16 and will continue to be supported thereby until the points of contact of the loops with belt 45 reach the tangent points TG (FIG. 7). Thus, each loop will fall in a generally horizontal plane at the same point into the reform tub T or on the mandrel M. The term "generally horizontal plane" is used since the loops overlying each other are not exactly horizontal. As a loop falls, it will exert a pulling force on the succeeding loop and pull it downwardly as it is released at the tangent points TG. Succeeding loops will fall in a generally horizontal plane about offset centers.

Figure 13:
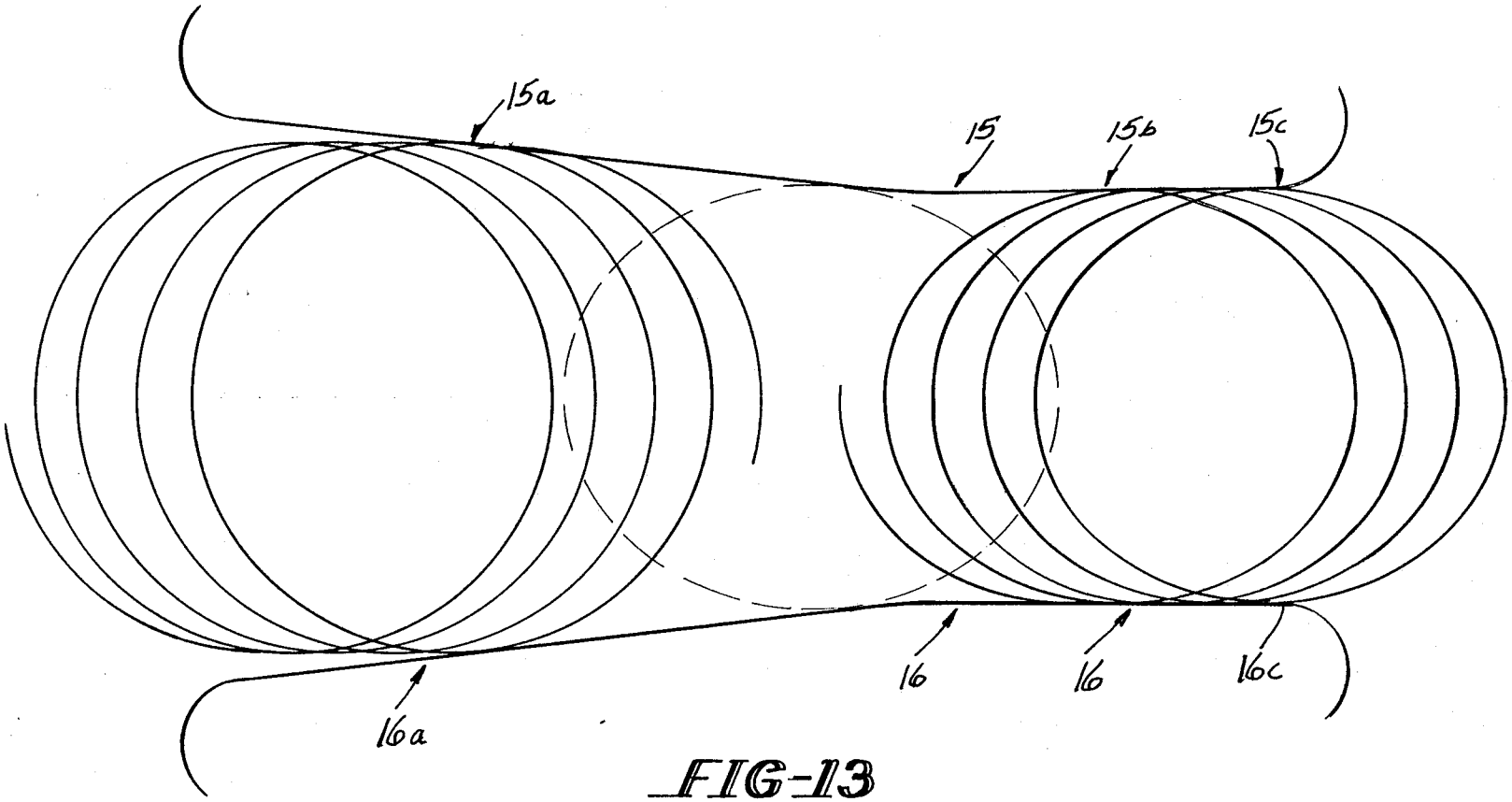
FIG. 13 is a schematic representation of FIG. 7 showing helices or loops of wire.

FIG. 13 is a schematic plan view showing helices moving between two pinching conveyor belts. As the helices advance along the tapered portions 15 and 16*a*, they are gradually compressed and finally compressed in the parallel portions 15*b* and 16*b*. As the helices pass beyond the tangent points 15*c* and 16*c*, they will drop off to a mandrel or reform tub at the same point with respect to the conveyor mechanisms 15 and 16. This ensures that each succeeding helix will fall in a generally horizontal orientation as it is released by the pinching mechanisms as exemplified in FIG. 9.

Figure 14:
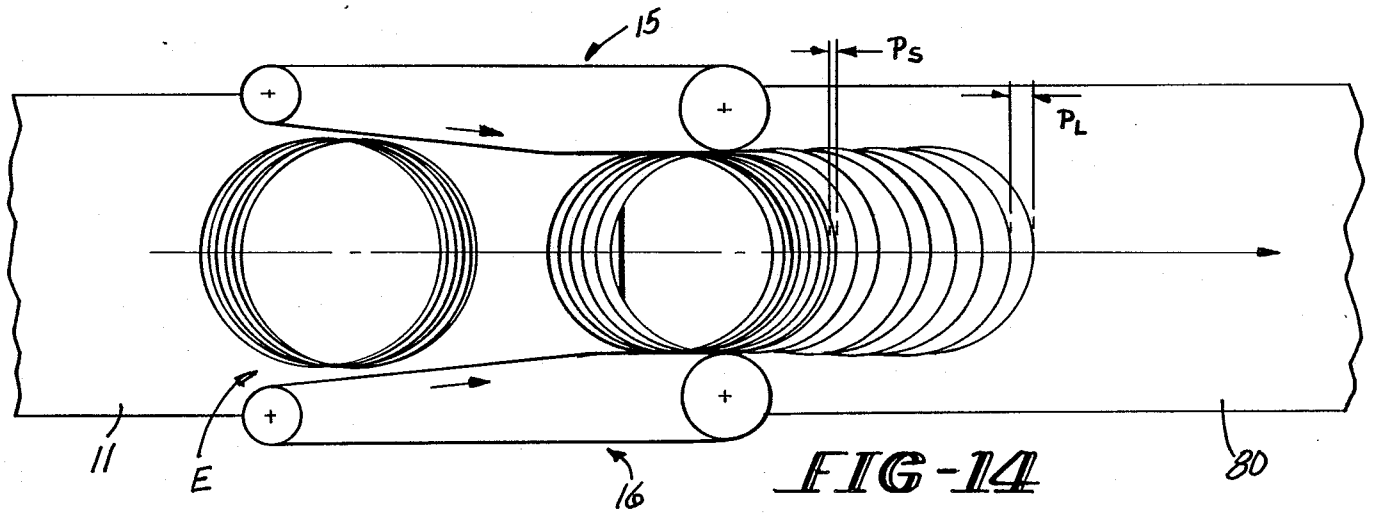
FIG. 14 is a schematic top plan view of another application of the invention.
Figure 15:
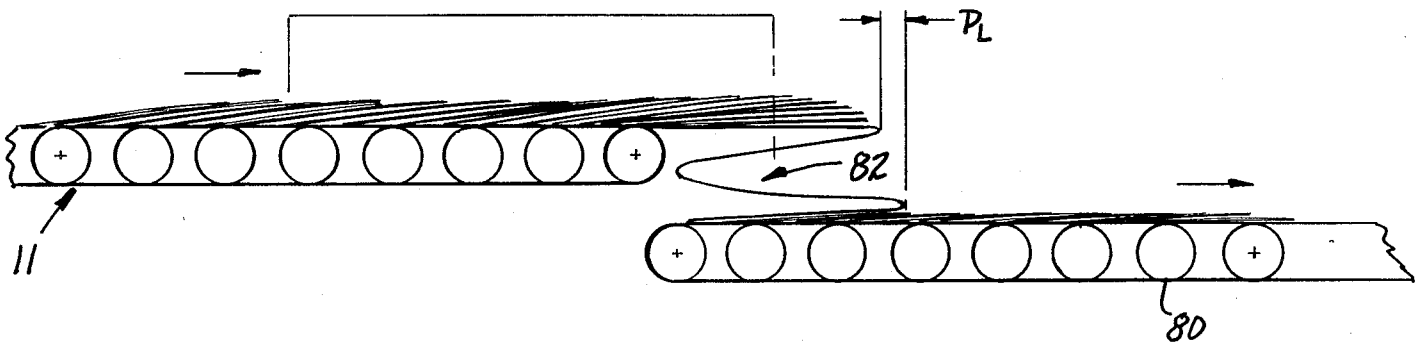
FIG. 15 is a schematic side elevation of FIG. 14 with a portion of the mechanism deleted.

FIGS. 14 and 15 schematically exemplify the invention utilized in a two conveyor system where a lower conveyor is run at a faster speed.

As shown in FIG. 14, the helices on a low speed conveyor on conveyor base 11 have a small pitch $P_S$ therebetween as they enter the conveyor belt mechanisms 15 and 16 on the horizontal conveyor on base 11. Positioned at a lesser height is a higher speed conveyor 80. As a helix falls as indicated at 82 to lower conveyor 80, it will accelerate with respect to the following helix and the pitch will increase to $P_L$. This exemplifies use of the invention in a slow cool process. In a slow cool process, a first conveyor running at a low speed accepts the coils at a small pitch $P_S$ therebetween. The lower speed provides more cooling time for the helices. Then the helices are transferred to a faster moving conveyor which leads to a reform tub T or mandrel M. This provides a controlled means for dropping each helix individually to a faster running conveyor which spreads the helices to a greater pitch $P_L$ which permits the forming of a better coil in a reform tub or on a mandrel. This application of the invention prevents the dropping of a plurality of loops having a small pitch $P_S$. Each loop is held and dropped individually by the pinching mechanisms.

It will be noted from FIG. 14 that as the helices leave the pinching mechanism, they will recover somewhat from the compression and are of a larger dimension than when in the parallel portions 15*b* (FIG. 13) of the pinching conveyors. In this embodiment, the pinching mechanisms are adjusted to a dimension therebetween which will not form a permanent set in the helices, but will only support the helices in a substantially horizontal position until each helice individually drops as it reaches the tangent points 15*c* and 16*c* (FIG. 13).

It is optional whether or not a second set of pinching mechanisms be used at the end of conveyor 80. The first set at the end of conveyor base 11 (FIG. 14) may be utilized primarily to hold a helix horizontal at the drop-off point. The second set of conveyors and supports therefor, if utilized, are also exemplified by FIGS. 7, 8, and 9.

The mechanisms 15 and 16 define a tapered entrance E (FIG. 14) therebetween which, at the entry, is of a dimension greater than the diameter of the loops. As the loops contact the tapered portions 15*a* and 16*a* (FIG. 13), the pinching mechanisms will act to center the loops on conveyor support 11 and gradually compress the loops as the loops continue to move between the pinching mechanisms. The conveyor belts 45 move at the same speed or slightly faster than conveyor chains 12. Thus, there will be no retarding of a loop as it enters the pinching mechanisms, which would tend to pile up the loops entering the pinching mechanisms.

It may thus be seen that the objects of the invention set forth, as well as those made apparent from the foregoing description, are efficiently attained. While preferred embodiments of the invention have been set forth for purposes of disclosure, modifications to the disclosed embodiments of the invention, as well as other embodiments thereof, may occur to those skilled in the art. Accordingly, the appended claims are intended to cover all embodiments of the invention and modifications to the disclosed embodiments which do not depart form the spirit and scope of the invention.

Having thus described the invention, what is claimed is:

1. Apparatus for use in conjunction with a rod mill of the type where metal is reduced down to rod stock and formed in loops and then transported on a horizontal conveyor to a collection device where the loops drop from the conveyor comprising compressing means disposed on either side of the conveyor adjacent the drop-off end thereof and spaced a distance apart which is less than the width of said loops for compressing said loops in one direction and elongating said loops in another direction as the helices pass through said compressing means.

2. The apparatus of claim 1 where said compressing means comprises a vertical conveyor on either side of said conveyor, said vertical conveyors defining a moving path for said loops and spaced apart a dimension less than the diameter of said loops.

3. The apparatus of claim 2 where said vertical conveyors define a path which tapers from a dimension larger than the diameter of said loops to said dimension less than the diameter of said loops.

4. The apparatus of claim 1 where said vertical conveyors are mounted on supports, and said supports are movable to vary the dimension between said vertical conveyors.

5. The apparatus of claim 2 where said vertical conveyors move at the same or slightly greater linear speed as said horizontal conveyor.

6. The apparatus of claim 1 further including a second horizontal conveyor positioned below said pinching means and arranged to move at a faster speed than said horizontal conveyor whereby as the loops drop to said second horizontal conveyor the pitch between succeeding loops is increased.

7. The apparatus of claim 1 where said pinching means support said loops in a generally horizontal plane as said loops leave said horizontal conveyor.

8. The apparatus of claim 2 where said vertical conveyors are endless, turn about a radius removed from said horizontal conveyor and have a tangent point with respect to said radius, said loops falling vertically from a substantially horizontal plane as said loops pass said tangent point.

9. Apparatus for use in dropping metal rod stock which is continuously formed in succeeding loops into a coil, where the loops are in overlapping relationship moving on a conveyor comprising, pinching means disposed on either side of a horizontal conveyor adjacent the drop-off end thereof and spaced a distance apart which is less than the width of said loops, said pinching means including movable means engaging said loops for compressing said loops in one direction and elongating said loops in another direction as the loops pass through said pinching means and held in a generally horizontal plane, after exiting the conveyor, and dropped vertically from engagement with said movable means.

10. The apparatus of claim 9 where said movable means on said pinching means comprises a vertical movable conveyor on either side of said horizontal conveyor, said vertical conveyors defining a moving path for said loops and spaced apart a dimension less than the diameter of said loops.

11. The apparatus of claim 10 where said vertical conveyors define a path which tapers from a dimension larger than the diameter of said loops to said dimension less than the diameter of said loops.

12. The apparatus of claim 9 where said vertical conveyors are mounted on supports, and said supports are movable to vary the dimension between said vertical conveyors.

13. The apparatus of claim 10 where said vertical conveyors move at the same or slightly greater linear speed as said horizontal conveyor.

14. The apparatus of claim 9 where said pinching means support said loops in a generally horizontal plane as said loops leave said horizontal conveyor.

15. The apparatus of claim 10 where said vertical conveyors are endless, turn about a radius removed from said horizontal conveyor and have a tangent point with respect to said radius, said loops falling vertically from a substantially horizontal plane as said loops pass said tangent point.

16. A method of forming rod stock which is in loops on a conveyor and drops off the end thereof, which comprises the steps of progressively compressing said loops in a generally horizontal plane adjacent the end of the conveyor to cause said loops to take a cast in which the approximate centers of the loops are on an imaginary accurate line; supporting said loops past the end of the conveyor and dropping succeeding loops at the same point to a collection device.

17. The method of claim 16 including the step of providing a second conveyor at a lower elevation than said conveyor and having a greater linear speed than said conveyor as a collection device whereby as said loops fall to said second conveyor, the pitch between the succeeding loops increases.

18. A method of forming loops of rod stock on a conveyor in which the loops drop off the end of the conveyor, which comprises the steps of progressively compressing said loops in a horizontal plane adjacent the end of the conveyor to cause said loops to take an elliptical cast, supporting said loops in a generally horizontal plane past the end of the conveyor and dropping succeeding cast loops vertically at the same point to a collection device.

19. The method of claim 18 including the step of providing a second conveyor at a lower elevation than said conveyor and having a greater linear speed than said conveyor as a collection device whereby as said loopsffall to said second conveyor, the pitch between the succeeding loops increases.

20. A method of reshaping loops of rod stock as it moves on a conveyor to a collection device which comprises the steps of compressing said loops as they move along the conveyor to define a permanent set therein, holding the compressed loops in a generally horizontal plane, and dropping each loop from the same location to the collection device from the generally horizontal plane.

21. The method of claim 20 including the step of providing a second conveyor at a lower elevation than said conveyor and having a greater linear speed than said conveyor as a collection device whereby as said loops fall to said second conveyor, the pitch between the succeeding loops increases.

22. A method of forming rod stock which is in loops on a conveyor and drops off the end thereof, which comprises the steps of compressing said loops in a generally horizontal plane adjacent the end of the conveyor to cause said loops to take a cast in which the approximate centers of the loops are on an imaginary accurate line; supporting said loops past the end of the conveyor and dropping succeeding loops at the same point to a collection device.

23. The method of claim 22 including the step of providing a second conveyor at a lower elevation than said conveyor and having a greater linear speed than said conveyor as a collection device whereby as said loops fall to said second conveyor, the pitch between the succeeding loops increases.

* * * * *

UNITED STATES PATENT AND TRADEMARK OFFICE

CERTIFICATE OF CORRECTION

PATENT NO. : 4,914,935

DATED : April 10, 1990

INVENTOR(S) : George R. Fryer

It is certified that error appears in the above-identified patent and that said Letters Patent are hereby corrected as shown below:

IN THE CLAIMS

Column 8, Claim 19, Line 25, delete "loopsffall" and substitute therefor -loops fall-.

Column 8, Claim 22, Line 46, delete "accurate" and substitute therefor -arcuate-.

Signed and Sealed this

Nineteenth Day of March, 1991

*Attest:*

*Attesting Officer*

HARRY F. MANBECK, JR.

*Commissioner of Patents and Trademarks*